United States Patent [19]

Hessemann

[11] Patent Number: 4,601,134

[45] Date of Patent: Jul. 22, 1986

[54] BELT GRINDER HAVING PRESSURE PADS WITH INDIVIDUALLY VARIABLE CONTACT PRESSURES

[75] Inventor: Jürgen Hessemann, Bad Oeynhausen, Fed. Rep. of Germany

[73] Assignee: Karl Heesemann Maschinenfabrik GmbH & Co. KG, Bad Oeynhausen, Fed. Rep. of Germany

[21] Appl. No.: 690,987

[22] Filed: Jan. 14, 1985

[30] Foreign Application Priority Data

Jan. 21, 1984 [DE] Fed. Rep. of Germany ..... 3402104

[51] Int. Cl.[4] ..... B24B 21/08

[52] U.S. Cl. ..... 51/138; 51/141

[58] Field of Search ..... 51/141, 135 R, 138 R

[56] References Cited

U.S. PATENT DOCUMENTS

| | | | |
|---|---|---|---|
| 3,167,889 | 2/1965 | Jacobi | 51/141 |
| 3,374,583 | 3/1968 | Jacobi | 51/141 |
| 3,660,950 | 5/1972 | Takeyama et al. | 51/328 |
| 3,694,966 | 10/1972 | Heesemann | 51/141 |
| 3,859,757 | 1/1975 | Heesemann | 51/141 |
| 3,911,627 | 10/1975 | Heesmann | 51/141 |
| 3,939,611 | 2/1976 | Hesler | 51/141 |
| 4,527,359 | 7/1985 | Stump | 51/141 |

FOREIGN PATENT DOCUMENTS

| | | | |
|---|---|---|---|
| 1148465 | 11/1963 | Fed. Rep. of Germany . | |
| 372945 | 12/1963 | Fed. Rep. of Germany . | |
| 477263 | 10/1969 | Fed. Rep. of Germany . | |
| 1921566 | 12/1970 | Fed. Rep. of Germany . | |
| 2136597 | 2/1973 | Fed. Rep. of Germany . | |
| B37580 | 7/1974 | Fed. Rep. of Germany . | |
| 1502449 | 12/1976 | Fed. Rep. of Germany . | |
| 1577368 | 12/1978 | Fed. Rep. of Germany | 51/141 |
| 2845366 | 5/1979 | Fed. Rep. of Germany | 51/141 |
| 2757314 | 3/1980 | Fed. Rep. of Germany . | |
| G8223923.1 | 4/1982 | Fed. Rep. of Germany . | |
| G8307096.6 | 7/1983 | Fed. Rep. of Germany . | |

OTHER PUBLICATIONS

European Search Report.

*Primary Examiner*—Harold D. Whitehead

*Attorney, Agent, or Firm*—Schwartz, Jeffery, Schwaab, Mack, Blumenthal & Evans

[57] ABSTRACT

A belt grinder with a pressure beam comprising a plurality of pressure pads arranged adjacent to each other, aligned transversely to the direction of transport of a workpiece and with a variable contact pressure, with grinding belts being guided over the surface of the workpiece to process it, with provision for varying individually and continuously the contact of each pressure pad so that uniform surface working may be obtained.

17 Claims, 4 Drawing Figures

BELT GRINDER HAVING PRESSURE PADS WITH INDIVIDUALLY VARIABLE CONTACT PRESSURES

BACKGROUND OF THE INVENTION

The invention concerns a belt grinder comprising a pressure beam with a plurality of pressure pads arranged adjacent to each other, said pressure beam being aligned transversely to the direction of the workpiece and exposed to a variable contact pressure and with a grinding belt being guided over it for the processing of the surface of the workpiece.

Belt grinders of this type have been known for a long period of time. They are capable of processing workpieces with complex surface configurations, if the arrangement of the pressure pads is such that they may be moved individually from an ineffective into an effective position. In this manner, the grinding belt is pressured onto the workpiece only in the area required by the shape of the workpiece.

A wide belt grinder of this type is known from German Gebrauchsmuster No. 82 23 923.1. A switch is associated with each pressure pad in the inlet area of the belt grinder. The switch is actuated whenever the workpiece passes over the appropriate location of the inlet area. A signal indicating that the pressure pad corresponding to this location is to be moved into its effective position is thereby transmitted to the pressure beam. For this purpose, an actuating voltage is conducted to an electromagnet connected with the pressure beam, so that the pressure pad is brought into its contact position (with a time delay in relation to the switch). The top side of the electromagnet rests on a pressure hose which, in turn, is supported stationarily at its upper side. By controlling the pneumatic pressure in the pressure hose, the contact pressure of the pressure beam may be regulated. The hose extends over the entire width of the pressure beam, thereby affecting all of the pressure pads uniformly.

SUMMARY OF THE INVENTION

The present invention is based on the recognition that the known differentiated control of the pressure beam needs improvement. For mechanical reasons, the width of the pressure pads and of the pressure belt guided over them cannot be reduced arbitrarily. It thus occurs that even though a workpiece protrudes into the range of a pressure pad, it may do so with a surface structure that is smaller than the width of the pressure pad involved. If the area is significantly smaller, the pressure pad, which applies a contact pressure equal to the contact pressures of the pressure pads applied over the entire surface of the workpiece, may undesirably cause the belt grinder to grind the surface structure away.

It is therefore an object of the present invention to provide a belt grinder of the aforementioned type, whereby an improved regulation of the grinding pressure onto the surface of the workpiece may be obtained.

This object is attained according to the invention by controlling the contact pressure of each pressure pad individually.

This is accomplished through provision of a belt grinder comprising a pressure beam which comprises a plurality of pressure pads arranged adjacent to each other in a line transverse to a direction of transport of said workpiece through said belt grinder; and contact pressure means, connected to each of the plurality of pressure pads, for varying individually and continuously the contact pressure which said pressure pad applies to said workpiece.

BRIEF DESCRIPTION OF THE DRAWINGS

The invention shall be explained in more detail with reference to exemplary embodiments shown in the following drawings. In the drawings.

DETAILED DESCRIPTION OF THE PREFERRED EMBODIMENT

Figure 1:
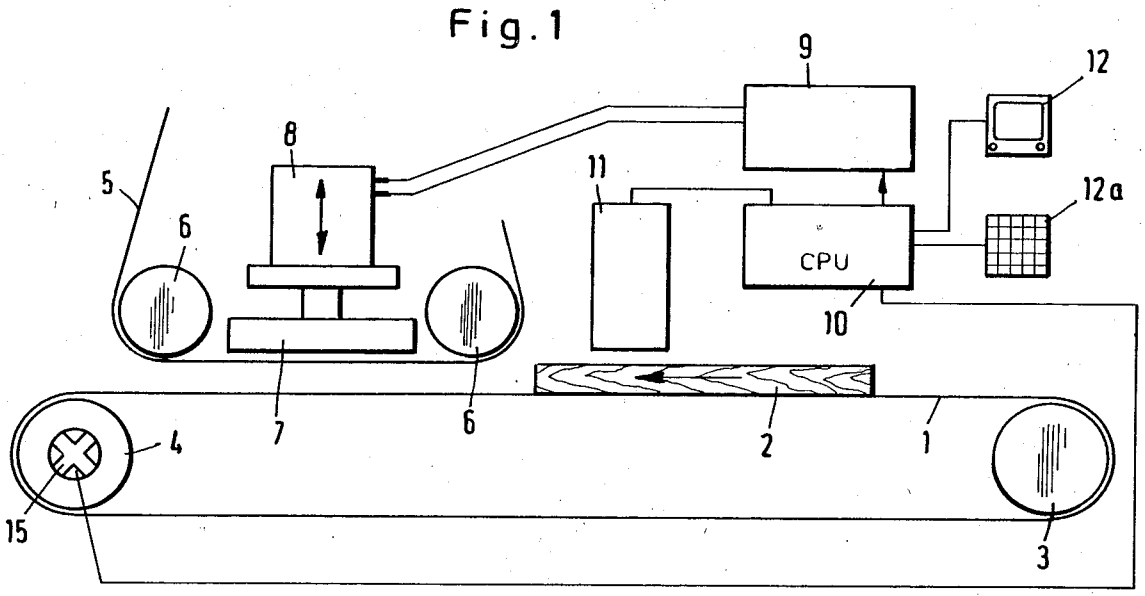
FIG. 1 shows a schematic lateral view of a wide belt grinder.

According to the invention, the contact pressures of each pressure pad may be regulated individually and continuously. It is thus possible to set the contact pressure lower, if necessary, in the edge areas involved than in the center range of the workpiece. The round grinding of edges and other fine surface structure may therefore be effectively prevented. In a similar manner, it is possible to take into account during grinding by means of the belt grinder according to the invention certain special conditions of the workpiece, for example protruding overlaps or the like, by increasing the grinding pressure.

Preferably, the pressure pads are controlled by means of electromagnets having a proportional pilot current-lifting power characteristic. Therefore, while known electromagnets merely performed a switching function, the electromagnets are now used to produce a contact pressure of the pressure pad that is proportional to an electric signal. In other words, prior art systems used the magnets merely to engage and disengage the pressure pads. The contact pressure of the pressure pad was therefore either zero or some predetermined, constant operational value. In the present invention, on the other hand, the contact pressure of the pressure pad can controllably and continuously assume values between zero and a predetermined maximum.

"Continuously" as used herein is meant to distinguish over the conventional "on-off" arrangements which have already been disclosed. It means that the nonzero contact pressure of each individual pressure pad can assume any value in a range of values instead of just one value. It will thus be apparent that "continuously" does not require that the contact pressure change smoothly from zero to its nonzero value, or between two nonzero values.

In a preferred embodiment, the electromagnets may be used to move the pressure pads into ineffective positions as required.

In a further embodiment, a plurality of detectors are arranged adjacent to each other and transverse to the direction of transport, positioned in front of the pressure beam. Specifically, each detector is aligned with an associated pressure pad, with the output signals of the detectors determining a pilot current for the electromagnet of the associated pressure pad. In this manner, the contact pressure may be controlled by the detectors. If, for example three detectors are associated with every pressure pad and only one detector is responding, this indicates that the workpiece is aligned with said pressure pad only over one third of the width of the pressure pad. This is recognized by means of the detectors, so that the contact pressure may be set for this particular pressure pad for example to one third of the force required for pressuring the entire surface.

The detectors preferably scan the workpiece without contact, for example by means of laser light barriers or the like.

It is conceivable alternately to feed the shape of the workpiece into a computer and to determine the contact pressure and duration in relation to the actual rate of advance of the workpiece. In this case the detectors may be eliminated.

In order to obtain an accurate sychronization of the onset and termination of the contact pressure or the variation of said contact pressure to alter the shape of the workpiece, it is advantageous to continuously measure the advance velocity of the workpiece and to regulate the contact pressure determined by the detectors as a function of said advance velocity. The feed belt may be equipped for this purpose with a pulse generator, so that the advance of the workpiece from the detectors to the pressure pad corresponds to a predetermined number of pulses. In this case the time delay between the detector signal and the onset of the corresponding control is obtained merely by counting the number of pulses generated.

The invention makes it possible further to take into account a variation in thicknesses of the workpieces during the grinding process. For this, thickness measuring devices are associated with each pressure pad for the determination of the pilot current. The determination of the pilot current as a function of the thickness of the workpiece assures the application of the same contact force to workpieces of different thicknesses. It has been found that controlling the pressure pad at a constant contact pressure for workpieces of different thicknesses produces different resultant grinding forces, since the grinding belt generates a differential counterforce to the force of the pressure pad as a function of the differential deflection by the pressure pad.

It is thus possible according to the invention to automatically determine the thickness of the workpiece and thereby generate a constant contact pressure of the grinding belt on the workpiece, even for different thicknesses of the workpiece.

In a simple embodiment a thickness measuring device may be a scanning roll pressing on the surface of the workpiece. The roll may, for example, by articulated rotatingly by means of a lever onto a stationary point, wherein the angular position of the lever is a measure of the thickness of the workpiece.

In a further form of embodiment, the thickness measuring device is able to work in a contactless manner, in that a light source produces a light beam obliquely striking the surface of the workpiece and a detector determines the position of the point of impact on the surface. In the case of thin workpieces, the point of impact is removed farther from the source of light than for thicker workpieces.

FIG. 1 shows a conveyor belt 1 for a workpiece 2. The transport belt runs between two reversing rolls 3 and 4, one of which is driven. To effect the surface processing desired, the workpiece 2 passes on the conveyor belt 1 under a grinding belt 5 in the form of an endless belt and guided around at least three reversing rolls 6. (The upper reversing roll is not shown in the drawing.) Two of the reversing rolls 6 are aligned parallel to the upper strand of the conveyor belt 1, so that the grinding belt 5 passes through a "grinding zone" defined between the two rolls 6 parallel to the upper strand of the grinding belt 1. The grinding belt 5 is pressed against the workpiece 2 between the two reversing rolls 6 by means of a pressure pad 7. The force of the pressure is set by means of an electromagnet 8, the exciting current of which is regulated through a power source 9 with the aid of a computer 10. The computer 10 is connected with a workpiece detection device 11, which recognizes the presence of a part of a workpiece within the range of the pressure pad 7 and passes on this information to the computer 10. The computer 10 is further connected with an input keyboard 12*a*, whereby for example the magnitude of the grinding pressure may be fed in the case of complete grinding for a certain workpiece 2. On a screen 12, also connected with the computer 10, the data fed into the computer may be displayed.

Figure 2:
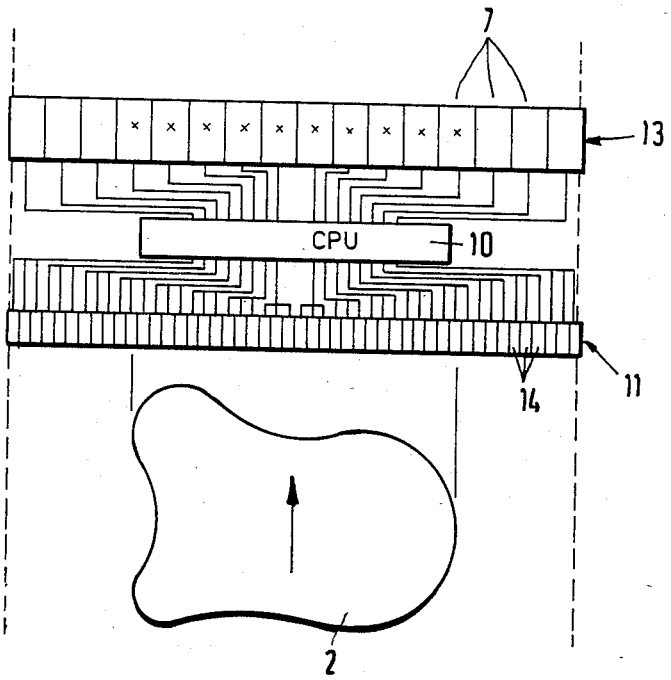
FIG. 2 shows a schematic top view of the wide belt grinder according to FIG. 1 with a detection device for the workpiece.

FIG. 2 shows that a plurality of pressure pads 7 arranged adjacent to each other form a grinding beam 13 aligned transversely to the direction of transport of the workpiece 2. The workpiece detection device 11 is aligned with the pressure beam 13 in the direction of transport of the workpiece 2. The detection device 11 consists of a plurality of individual detectors 14, arranged adjacent to each other, transversely to the direction of transport. Three of the detectors are always aligned with a pressure pad 7. The width of the pressure pad 7 is thus divided into three ranges by the detectors 14 and the detectors recognize whether the workpiece enters one, two or all three ranges of the pressure pad 7 involved. The corresponding information arrives in the computer 10, which thereupon produces the necessary exciting current for the electromagnet 8 of the pressure pad 7. The contact pressure of a pressure pad 7 the range whereof is entered only partially by the workpiece is therefore adjusted to an appropriate lower value. As the workpiece 2 is passing between the workpiece detection device 11 and the pressure beam 13 during a certain transportation period, actuation by the workpiece detection device 11 must not take place immediately. The setting of a fixed time delay is not desirable, as thereby fluctuations of the rate of advance of the conveyor belt 1 may not be taken into account and furthermore in case of a stoppage of the conveyor belt 1 an erroneous control signal is issued. For this reason, the reversing roll 4 is equipped with a pulse generator 15 (shown in FIG. 1). The pulses generated by pulse generator 15 are passed to the computer 10 which in turn need only await the arrival of a predetermined number of pulses to effect the control measure originated by the workpiece detection device 11.

Figure 3:
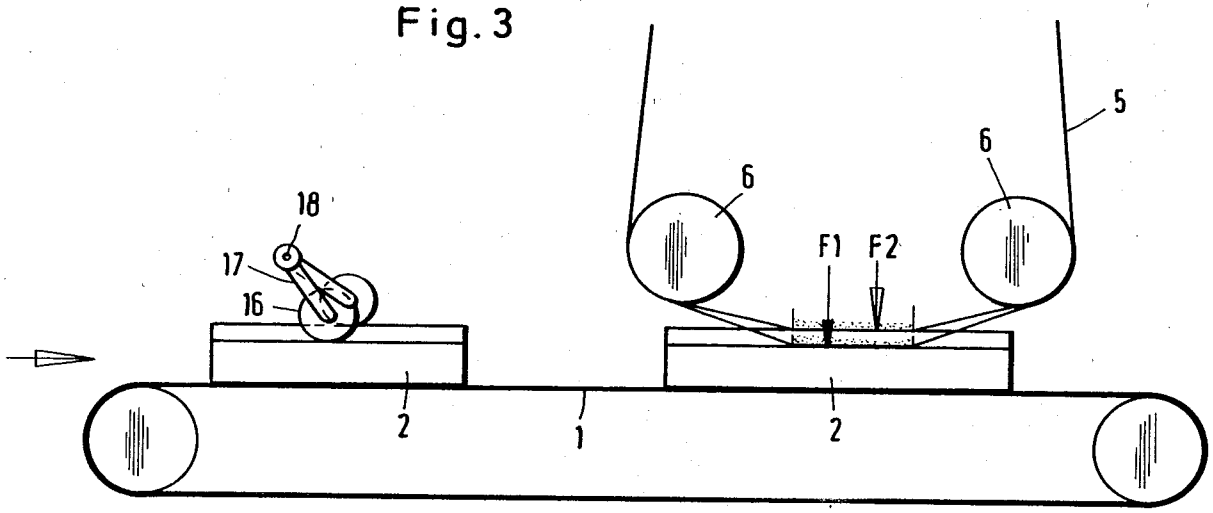
FIG. 3 shows a schematic view of a thickness measuring installation formed by a scanning roll and its effect on the grinder.
Figure 4:
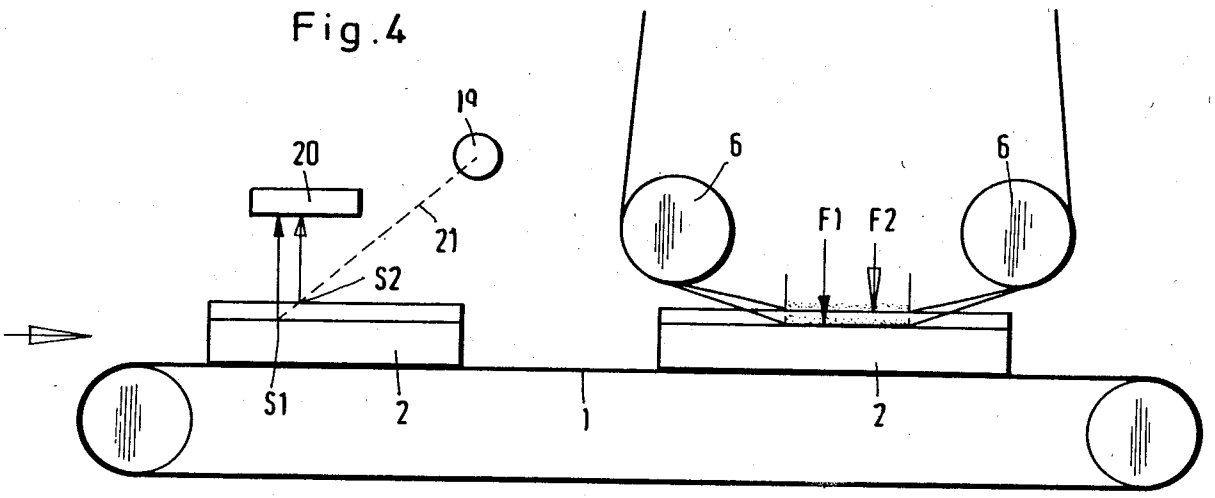
FIG. 4 shows a schematic view similar to FIG. 3 with a thickness measuring device operating without contact.

FIGS. 3 and 4 depict means for determining the thickness of the workpiece 2 in the determination of the contact pressure, made possible by the invention. For this purpose, a thickness measuring device is placed in front of the pressure pads 7.

In FIG. 3, the thickness measuring device consists of a scanning roll 16, which is articulated by means of a lever 17, rotatingly onto a fixed point 18. As shown in FIG. 3, workpieces 2 of different thickness lead to different angular positions of the lever 17. By means of an angular detector (not shown) at the point 18, a signal proportional to the thickness of the workpiece 2 may thus be produced.

The signal proportional to the thickness of the workpiece 2 may be processed in the computer 10 (FIG. 1) and used for the determination of the pilot current of the pressure pad 7 and thus of the contact pressure F. FIG. 3 shows diagrammatically in the right hand part that for a thinner workpiece 2, a higher contact pressure $F_1$ is produced, while for a thicker workpiece, a lesser contact pressure $F_2$ is produced. The contact pressures $F_1$ and $F_2$ produced by the pressure pad must be assured by providing equal contact pressures of the grinding belt 5 on the workpiece 2 in both cases. It must be taken into consideration here that the grinding belt must be deflected to a greater degree between the rolls 6 for a thinner workpiece 2 than for a thicker workpiece 2. Consequently, the grinding belt counters the contact pressure $F_1$ of the pressure pad 7 in case of a thinner workpiece 2 with a higher elastic counter force than with a thicker workpiece 7. This higher counter force is being compensated by the stronger contact pressure $F_1$ of the pressure pad 7.

In FIG. 4 only the thickness measuring device is different in relation to FIG. 3. The contactless thickness measuring device shown here consists of a source of light 19 and a light detector 20. The light source 19 emits a beam of light 21 obliquely with respect to the surface of the workpiece 2, which produces on the workpiece 2 a light spot S1, S2. The light detector 20 recognizes the position of the prevailing light spot S1, S2, thereby acquiring information concerning the thickness of the workpiece 2. In the case of a thinner workpiece the light spot S1 is produced farther away from the light source 19 than the light spot S2 in the case of a thicker light spot. The light detector 20 may consist for example of a pluraity of photosensors aligned linearly in the plane of the light beam 21, the photosensors being placed so that they recognize essentially only light that is perpendicularly incident onto the surface of the light detector. Thus, different photosensors of the light detector 20 respond according to different thicknesses of the workpiece 2. The information concerning the thickness of the workpiece 2 is thus obtained directly by determining which of the photosensors of the light detector 20 responds.

While the present invention has been described above with reference to exemplary embodiments, one of ordinary skill in the art will readily appreciate that embodiments which differ from those described above may be conceived which nonetheless do not depart from the present teachings. Therefore, the present invention should not be regarded as limited to the exemplary embodiments, but instead should be regarded as being at least comensurate in scope with the following claims.

What is claimed is:

1. A belt grinder for grinding a workpiece, comprising:

a pressure beam, said pressure beam comprising a plurality of pressure pads arranged adjacent to each other in a line transverse to a direction of transport of said workpiece through said belt grinder; and contact pressure means, connected to each of said plurality of pressure pads, for varying individually and continuously a contact pressure which said pressure pad applies to said workpiece, whereby a variation in contact presssure is provided along said pressure beam.

2. A belt grinder as claimed in claim 1 wherein said contact pressure means further comprises:

a plurality of electromagnets respectively connected to an associated one of said plurality of pressure pads; and pilot current means, electrically connected to each of said plurality of electromagnets, for generating individually a pilot current which causes said electromagnet to generate a proportional characteristic force.

3. A belt grinder as claimed in claim 2 wherein said characteristic force is a lifting force, and wherein said pilot current means is operable to cause said electromagnet to move said associated pressure pad into an ineffective position.

4. A belt grinder as claimed in claim 2 further comprising speed measuring means, connected to said pilot current means, for measuring a transport velocity of said workpiece through said belt grinder, and for controlling generation of said pilot current by said pilot current means.

5. A belt grinder as claimed in claim 1 wherein said contact pressure means further comprises a plurality of detectors, arranged adjacent each other in a line parallel to and forward of said transverse line, for detecting the presence of said workpiece in a predetermined zone, each of said detectors being operable to generate an output signal which controls the contact pressure of an associated pressure pad.

6. A belt grinder as claimed in claim 5 further comprising a plurality of electromagnets respectively connected to an associated one of said plurality of pressure pads, and responsively connected to an associated one of said plurality of detectors, wherein said detector is further operable to define a pilot current for said associated electromagnet.

7. A belt grinder as claimed in claim 6 further comprising speed measuring means, connected to each of said plurality of detectors, for measuring a transport velocity of said workpiece through said belt grinder, and for controlling generation of said pilot current by said detector.

8. A belt grinder as claimed in claim 6, wherein said detector is further operable to define a pilot current for an electromagnet adjacent said associated electromagnet.

9. A belt grinder as claimed in claim 4 further comprising a conveyor mechanism for transporting said workpiece through said belt grinder, and wherein said speed measuring means comprises pulse generating means, associated with said conveyor mechanism and connected to said pilot current means, for generating output pulses at a frequency proportional to the speed at which said conveyor mechanism conveys said workpiece through said belt grinder.

10. A belt grinder as claimed in claim 7, further comprising a conveyor mechanism for transporting said workpiece through said belt grinder, and wherein said speed measuring means comprises pulse generating means, associated with said conveyor mechanism and connected to said detector, for generating output pulses at a frequency porportional to the speed at which said conveyor mechanism conveys said workpiece through said belt grinder.

11. A belt grinder for grinding a workpiece, comprising:

a grinding belt;

a conveyor mechanism for conveying said workpiece through said machine in a predetermined direction and at a given speed;

a pressure beam arranged adjacent one of said conveyor mechanism and said belt, and comprising a plurality of pressure pads arranged adjacent each other in a line transverse to said predetermined direction;

contact pressure means, connected to each of said plurality of pressure pads, for varying individually and continuously a contact pressure which said pressure pad applies to said workpiece to cause said workpiece and said belt to contact, whereby a variation in contact pressure is produced along said pressure beam; and control means, connected to said contact pressure means, for generating a control signal for each of said plurality of pressure pads which controls at least one of the initiation, duration, and magnitude of said contact pressure for said each pressure pad.

12. A belt grinder as claimed in claim 11 wherein said contact pressure means comprises a plurality of electromagnets respectively associated with one of said plurality of pressure pads, and wherein said control means is operable to produce a control signal which is a current signal.

13. A belt grinder as claimed in claim 12 wherein said control means further comprises a plurality of detecting means arranged adjacent each other in a line parallel to and forward of said transverse line and respectively associated with one of said plurality of pressure pads, for detecting the presence of said workpiece at a predetermined position, said control means being operable to vary said control signal at least in response to said detection.

14. A belt grinder as claimed in claim 13 further comprising speed measuring means, connected to said control means, for measuring the speed with which said conveying means conveys said workpiece through said belt grinder, and for generating a measured speed indication in accordance with said measured speed, said control means being operable to vary said control signal at least in accordance with said measured speed indication.

15. A belt grinder as claimed in claim 11 further comprising means, connected to said control means, for measuring the thickness of said workpiece and for producing a thickness indication in accordance with said measured thickness, said control means being operable to vary said control signal at least in accordance with said thickness indication.

16. A belt grinder as claimed in claim 15 wherein said thickness measuring means comprises a plurality of scanning rolls pressing on said workpiece, each of said scanning rolls being associated with a respective one of said pressure pads.

17. A belt grinder as claimed in claim 15 wherein said thickness measuring means comprises:

a light source operable to generate a light beam striking an upper surface of said workpiece at an oblique angle; and a detector operable to detect the position at which said light beam strikes said upper surface of said workpiece.

* * * * *